US008186529B2

(12) United States Patent
Kinmont et al.

(10) Patent No.: US 8,186,529 B2
(45) Date of Patent: May 29, 2012

(54) CHANNEL FEATURES FOR PRESSURIZED BOTTLE

(75) Inventors: Malcolm Kinmont, Paddington (AU); Tracey M. Momany, Sylvania, OH (US); Robert J. Groll, Oregon, OH (US)

(73) Assignee: The Coca-Cola Company, Atlanta, GA (US)

( * ) Notice: Subject to any disclaimer, the term of this patent is extended or adjusted under 35 U.S.C. 154(b) by 1318 days.

(21) Appl. No.: 11/467,626

(22) Filed: Aug. 28, 2006

(65) Prior Publication Data

US 2008/0050478 A1 Feb. 28, 2008

(51) Int. Cl.
*B65D 1/02* (2006.01)
*B65D 1/42* (2006.01)
*B65D 23/10* (2006.01)

(52) U.S. Cl. ..... 215/383; 215/384; 220/669; 220/675; 220/771

(58) Field of Classification Search ..... 215/382–384, 215/398; 220/669, 675, 771
See application file for complete search history.

(56) References Cited

U.S. PATENT DOCUMENTS

| | | | | | |
|---|---|---|---|---|---|
| D193,637 | S | * | 9/1962 | Ferraro | D9/556 |
| 4,151,249 | A | * | 4/1979 | Lee | 264/520 |
| 4,978,015 | A | * | 12/1990 | Walker | 215/375 |
| 5,080,244 | A | * | 1/1992 | Yoshino | 215/375 |
| 5,261,543 | A | * | 11/1993 | Ugarelli | 215/375 |
| 5,472,105 | A | | 12/1995 | Krishnakumar et al. | |
| 5,593,056 | A | * | 1/1997 | Mero et al. | 215/382 |
| 5,598,941 | A | | 2/1997 | Semersky et al. | |
| 5,735,421 | A | | 4/1998 | Deemer et al. | |
| 5,740,934 | A | * | 4/1998 | Brady | 215/381 |
| 6,006,952 | A | * | 12/1999 | Lucas | 222/211 |
| 6,095,360 | A | * | 8/2000 | Shmagin et al. | 215/382 |
| 6,112,925 | A | * | 9/2000 | Nahill et al. | 215/382 |
| 6,145,681 | A | * | 11/2000 | Chimetto et al. | 215/384 |
| 6,149,024 | A | | 11/2000 | Deemer et al. | |
| 6,161,713 | A | * | 12/2000 | Krich | 215/384 |
| 6,213,326 | B1 | * | 4/2001 | Denner et al. | 215/383 |
| D469,360 | S | * | 1/2003 | Moore et al. | D9/556 |
| 7,455,189 | B2 | * | 11/2008 | Lane et al. | 215/381 |
| 2002/0033376 | A1 | * | 3/2002 | Gaydosh et al. | 215/375 |
| 2003/0000912 | A1 | | 1/2003 | Deubel et al. | |
| 2004/0026357 | A1 | | 2/2004 | Beck et al. | |

* cited by examiner

*Primary Examiner* — Sue Weaver
(74) *Attorney, Agent, or Firm* — Sutherland Asbill & Brennan, LLP

(57) ABSTRACT

A pressure resistant thermoplastic container. The container may include a sidewall and a number of indentations formed in the sidewall. One or more of the indentations may include one or more reinforcements formed therein.

22 Claims, 6 Drawing Sheets

CHANNEL FEATURES FOR PRESSURIZED BOTTLE

TECHNICAL FIELD

The present application relates generally to plastic containers and more particularly relates to a plastic bottle having indented surface features for use with a pressurized liquid therein.

BACKGROUND OF THE INVENTION

Plastic bottles may come in any number of shapes, sizes, and configurations. Plastic bottles can be molded or otherwise manufactured as desired. This is particularly true with plastic bottles that are intended to be used with non-pressurized beverages. The numerous designs and patents concerning "hot fill" or other types of non-pressurized bottles, however, simply are not relevant to the goals described herein.

Plastic bottles that are intended to be used with pressurized beverages or liquids have far fewer designs options given the internal pressurization. For example, a carbonated soft drink container may have about four (4) volumes of carbon dioxide dissolved therein. In extreme circumstances, the container may develop an internal pressure of as much as about 90 pounds per square inch (about 6.2 bar) or more at a temperature of about 95 degrees Fahrenheit (about 35 degrees Celsius). Such an internal pressure can easily distort or deform many types of surface features that may be molded into the container wall. Such distortion or deformation may lead to the surface features not being evident to the consumer or even to the failure of the container wall.

What is desired, therefore, is an improved plastic container with surface features that can withstand the usual pressure involved with a carbonated soft drink or similar types of pressurized beverage and liquids. The bottle or container preferably should maintain its surface features during filling, distribution, opening, and in use.

SUMMARY OF THE INVENTION

The present application thus describes a pressure resistant thermoplastic container. The container may include a sidewall and a number of indentations formed in the sidewall. One or more of the indentations may include one or more reinforcements formed therein.

The pressure resistant thermoplastic container further may include a pressurized beverage therein. The pressurized beverage may be pressurized up to about one hundred (100) pounds per square inch (about seven (7) bar). The container may be made out of PET (polyethylene terephthalate) or similar types of materials. The sidewall may include a grip portion.

The indentations may include a number of channels. The channels may include a first end, a middle portion, and a second end. The first end and the second end may include the reinforcements formed therein. The middle portion may lack the reinforcements. The indentations may include a first column on a first side of one of the reinforcements and a second column on a second side of the reinforcement. The first column and the second column may be indented portions and the reinforcement may include a raised rib or an indented rib. A third column and a second raised or indented rib also may be used. The indentations may include a bowed surface and the reinforcement may include the apex of the bowed surface or a rib formed in the bowed surface. The rib may be an indented rib.

The present application further describes a pressure resistant thermoplastic bottle. The bottle may include a sidewall and a number of indentations formed in the sidewall. The indentations may include means for reinforcement formed therein.

The pressure resistant thermoplastic bottle further may include a beverage therein pressurized up to about one hundred (100) pounds per square inch (about seven (7) bar). The indentations may include a number of channels. The means for reinforcement may include a raised rib, an indented rib, a number of raised or indented ribs, and an apex of a bowed surface.

The present application further describes a pressure resistant thermoplastic bottle. The bottle may include a sidewall and a number of channels formed in the sidewall. The channels may include a first end, a middle portion, and a second end. The first end may include a first reinforced segment and the second end may include a second reinforced segment.

The first reinforced segment and the second reinforced segment may include a raised rib or an indented rib. The first reinforced segment and the second reinforced segment also may include an apex of a bowed surface or a rib in a bowed surface. A number of first reinforced segments and a number of second reinforced segments also may be used.

These and other features of the present application will become apparent to one of ordinary skill in the art upon review of the following detailed description when taken in conjunction with the several drawings and the appended claims.

DETAILED DESCRIPTION

Figure 1:
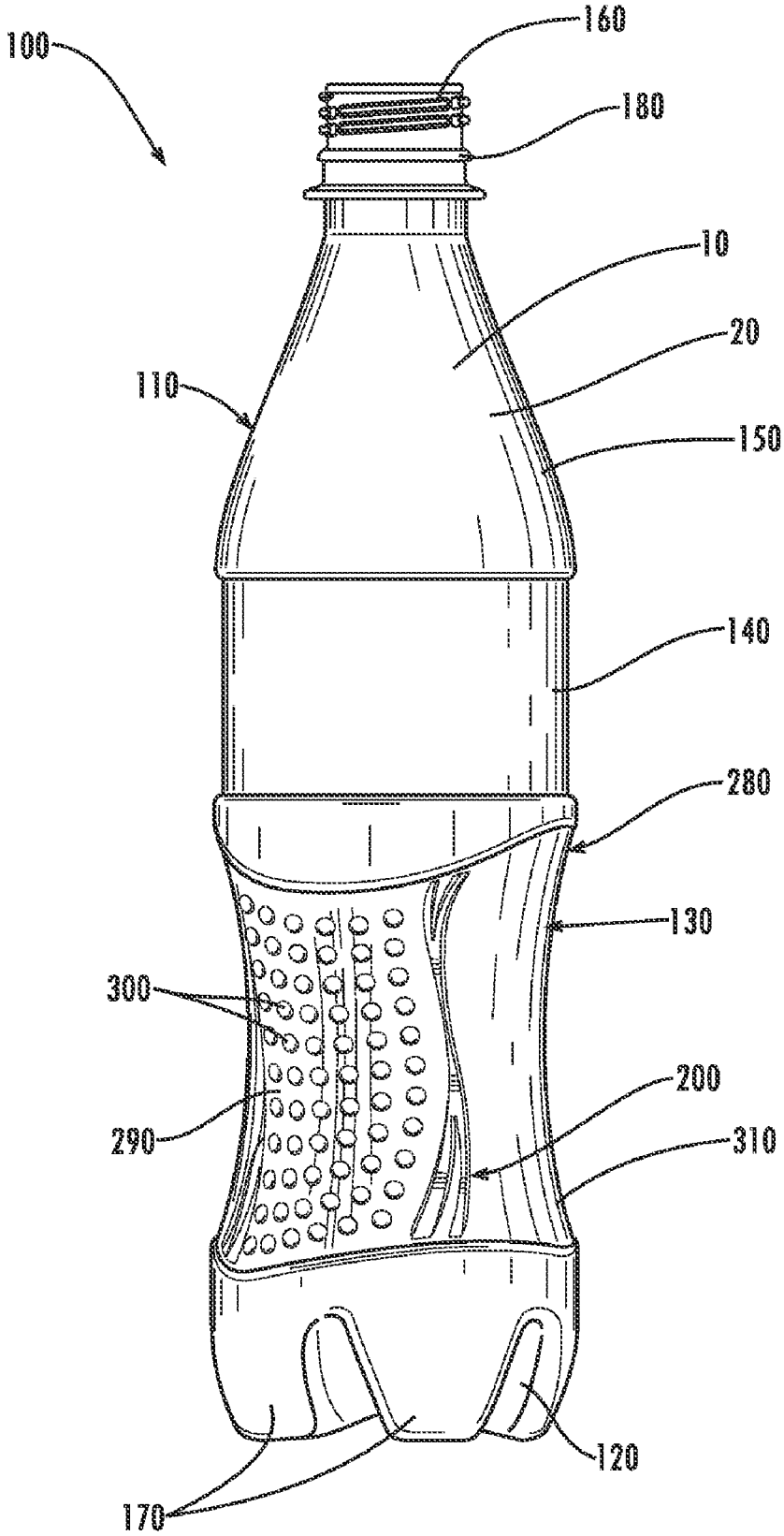
FIG. 1 is a perspective view of a bottle as is described herein.

The bottles described herein are intended to be used with a fluid 10. By way of example, the fluid 10 may be a pressurized beverage 20 such as a carbonated soft drink and the like. As described above, the carbonated soft drink may develop a significant internal pressure given the amount of carbon dioxide dissolved therein. The bottles described herein also may be used with other types of pressurized beverages. For example, water products may be pressurized with a volume of nitrogen following filling so as to maintain the bottle with a rigid feel. Other types of pressurized beverage or other types of fluids may be used herein. The internal pressure typically may range from about eight (8) pounds per square inch (about 0.5 bar) or so for lightly carbonated beverages or beverages that include the nitrogen flush to about 65 pounds per square inch (about 4.5 bar) or more for typical carbonated soft drinks and the like. As described above, however, the internal pressure may be as high about one hundred (100) pounds per square inch (about seven (7) bar).

Figure 2:
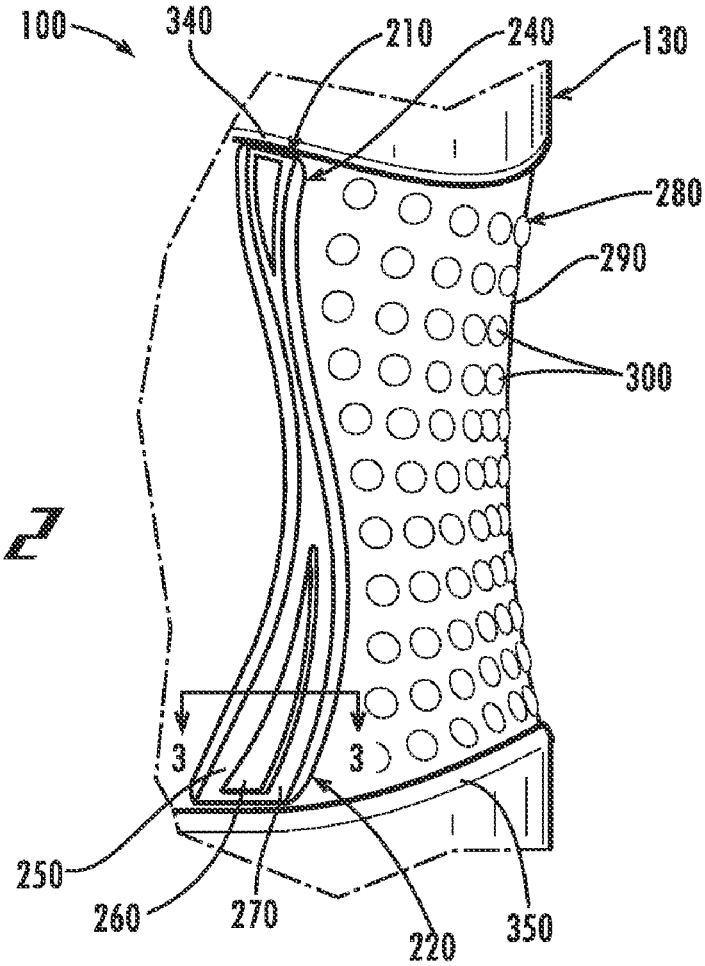
FIG. 2 is a side plan view of the bottle of FIG. 1.
Figure 3:
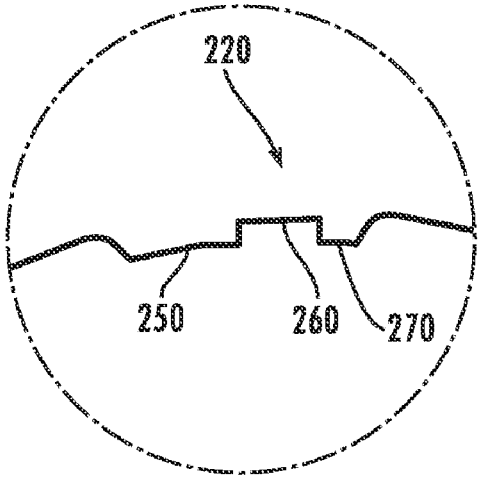
FIG. 3 is a side cross-sectional view of a channel of the bottle of FIG. 1.

Referring now to the drawings, in which like numbers refer to like elements throughout the several view, FIGS. 1-3 show a container 100 as is described herein. As is shown, the container 100 may take the shape of a bottle 110. Any other type of container configuration also may be used herein. Generally described, the bottle 110 includes a base 120, a grip portion 130, a label portion 140, a neck 150, and an opening 160. The bottle 110 may be made out of PET (polyethylene terephthalate). Further, similar types of thermoplastics such as PLA (polylactide acid), pp (polypropylene), or other types of materials may be used herein. The bottle 110 may be manufactured by blow molding (which may include injection stretch blow molding (one or two steps or otherwise) and extrusion blow molding), or similar types of forming techniques. The thermoplastic material may be substantially clear or translucent. By substantially clear or translucent, we mean that the consumer can view the contents of the bottle. Colored, clear, or other translucent materials also may be used herein.

The base 120 of the bottle 110 may be of conventional design. For example, the base 120 may have a number of petaloid feet 170 or other types of support structures formed therein such that the bottle 110 as a whole can stand upright. Alternatively, the base 120 may be rounded and a separate plastic cup may be used. The base 120 may take any other desired shape.

The label portion 140 of the bottle 110 also may be of conventional design. The label portion 140 may be a relatively flat surface for the application of a label or other type of covering. The label potion 140 can have any desired size and shape. The bottle 110 may have one or more labels thereon as desired. The label portion 140 may be omitted if desired.

The neck portion 150 also may be of conventional design. The neck potion 150 may have any desired size or shape. The neck 150 leads to the mouth 160. The mouth 160 also may be of conventional design. The mouth 160 may have a number of threads 180 formed therein such that a cap may be positioned thereon so as to close the bottle 110. Other closure methods may be used herein.

The grip portion 130 may have a substantially concave shape. Any desired shape, however, may be used herein. The concave shape promotes the ease of grasping and holding the bottle 110 within a consumer's hand. The grip portion 130 may have a number of channels 200 formed therein. In this example, the channels 200 are largely elongated indented portions formed within the wall of the bottle 100. The channels 200 may take any desire size or shape. Although the channels 200 are shown as extending vertically up and down the grip portion 130, the channels 200 may extend in any desired direction. The bottle 110 has four (4) channels 200, but any number of channels 200 may be used herein.

Each of the channels 200 may have a first end 220, a middle portion 230, and a second end 240. The first end 220 may include a first column 250, a rib 260, and a second column 270. The second end 240 also includes the first column 250, the rib 260, and the second column 270. The middle portion 230 has no such internal structure. In this example, the columns 250, 270 are indented portions and the rib 260 is a raised portion. Other examples, however, will follow. The ribs 260 act as reinforcing structure for the ends 220, 240 and the channel 200 as a whole. The ribs 260 may take any desired shape and size. The respective first columns 250, ribs 260, and second columns 270 may have differing sizes and shapes. The corners of the columns 250, 270 and the ribs 260 generally are curved to prevent delamination.

By way of example only, the first end 220 may have a width of about 0.45 inches (about 11.4 millimeters) and a length of about 0.9 inches (about 23.2 millimeters). The first column 250 of the first end 220 may have a depth of about 0.035 inches (about 0.9 millimeters) and a beginning width of about 0.2 inches (about 4.9 millimeters). The rib 260 may start with a width of about 0.15 inches (about 3.8 millimeters) and then disappear in width and depth as the channel 200 moves towards the middle portion 230. The second column 270 may have a similar depth and a beginning width of about 0.1 inches (about 2.7 millimeters).

The middle portion 230 may have a length of about 1.3 inches (about 33.4 millimeters) and a width at its narrowest portion of about 0.1 inches (about 2.5 millimeters). The middle portion 230 may not have an internal structure because of its narrow width.

The second end 240 may have a width of about 0.2 inches (about 5.7 millimeters). The first column 250 of the second end 240 may have a beginning width of about 0.06 inches (about 1.6 millimeters) and a depth of about similar to that of the first end 220. The rib 260 may start with a width of about 0.09 inches (about 2.2 millimeters) and then disappear in width and depth as the channel 200 moves towards the middle portion 230. The second column 270 may have a beginning width of about 0.07 inches (about 1.9 millimeters) and a similar depth. These dimensions may vary as desired.

The dimensions of the channel 200 as a whole, the first end 220, the middle portion 230, and the second end 240 as well as the respective columns 250, 270, and ribs 260 may vary as desired. More important than the various dimensions is the ratio of the width of the columns 250, 270 and the ribs 260. For example, the first end 220 is wider than the second end 240. As a result, the rib 260 of the first end 220 is wider than the rib 260 of the second end 240. Likewise, the middle portion 230 needs no rib 260 because it is a relatively narrow portion of the channel 200 and can withstand the internal pressures. The depth of the channels 200 may reach about 0.2 inches (about five (5) millimeters) or more depending upon the overall geometry of the bottle 100.

The grip portion 130 also may include a number of grip panels 280. In this case, two bubble panels 290 with a number of raised bubbles 300 and two intermediate panels 310. Other designs may be used herein. The panels 290, 310 also may have an indication of the source formed therein. The grip panels 280 may have a sinusoidal top and bottom 340, 350. Any desired shape, however, may be used herein. The grip panels 280 make the bottle 110 as a whole easy to grip and provide the consumer with a tactile sense.

Figure 4:
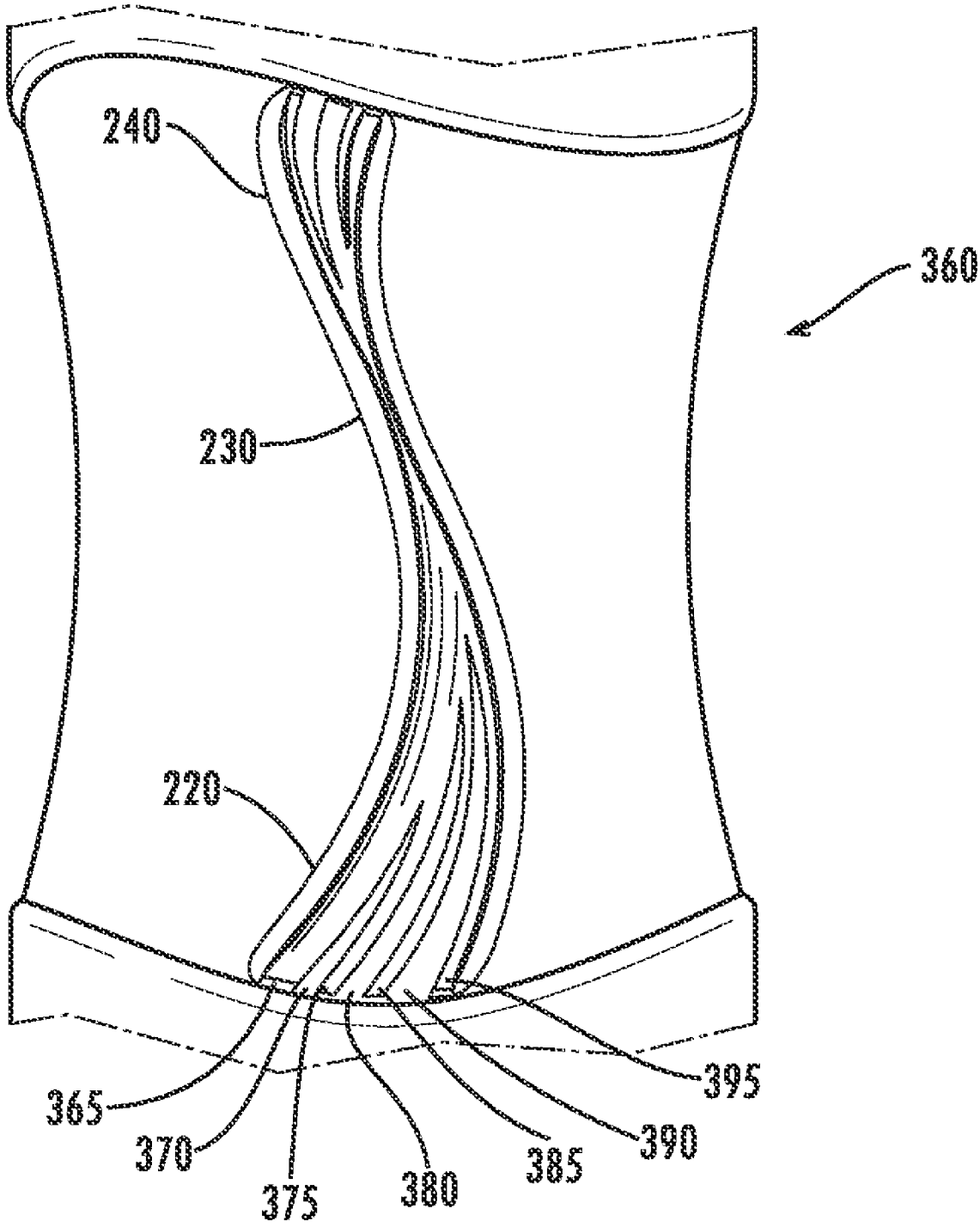
FIG. 4 is a side plan view of an alternative bottle.

FIG. 4 shows a bottle 360 with one or more channels 200 with multiple ribs 260 positioned therein. As is shown, each of the channels 200 may have the first end 220, the middle portion 230, and the second end 240. The first end 220 may include a first column 365, a first rib 370, a second column 375, a second rib 380, a third column 385, a third rib 390, and a fourth column 395. The number of ribs 370, 380, 390 as well as the number of columns 365, 375, 385, 395 may vary as desired. The ribs 370, 380, 390 may be raised or indented. The middle portion 230 and the second end 240 may have similar dimensions to those described above.

Figure 5:
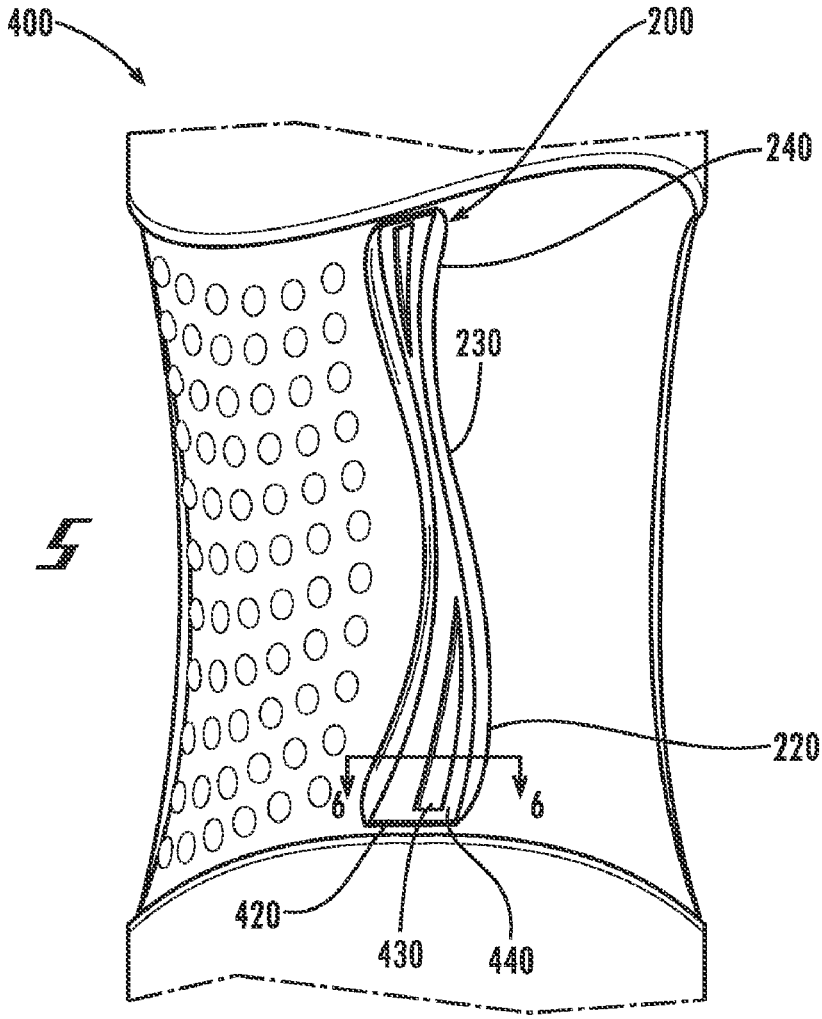
FIG. 5 is a side plan view of an alternative bottle.
Figure 6:
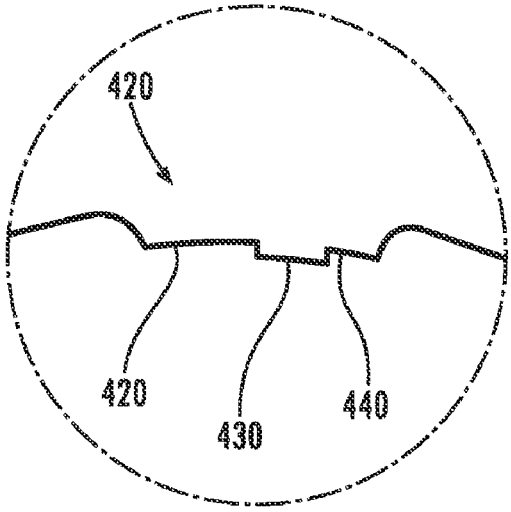
FIG. 6 is a side cross-sectional view of the bottle of FIG. 5.

FIGS. 5 and 6 show an alternative embodiment of a bottle 400 as is described herein. The bottle 400 also includes a number of channels 200 with the first end 220, the middle portion 230, and the second end 240. In this embodiment, however, the first end 220 has an overall width of about 0.35 inches (about 8.96 millimeters). The first end 220 of the channel 200 also includes a first column 420, a rib 430, and a second column 440. In this embodiment, the first column 420 is indented as compared to the rest of the grip panel 130 in a manner similar to that described above. The first column 420 may have an indentation that varies from about 0.06 inches (about 1.5 millimeters) to about 0.02 inches (about 0.5 millimeters). The rib 430 in this example, however, is further indented as compared to the raised rib 260 described above. In this example, the indented rib 430 has a further depth of about 0.2 inches (about 0.6 millimeters). The second column 440 may have a depth similar to the first column 420 but may have less width. The use of the indented rib 430 also provides the necessary structural support for the channel 410 as a whole. The middle portion 230 and the second end 240 may be proportionally dimensioned as above. Other sizes and shapes may be used herein.

Figure 7:
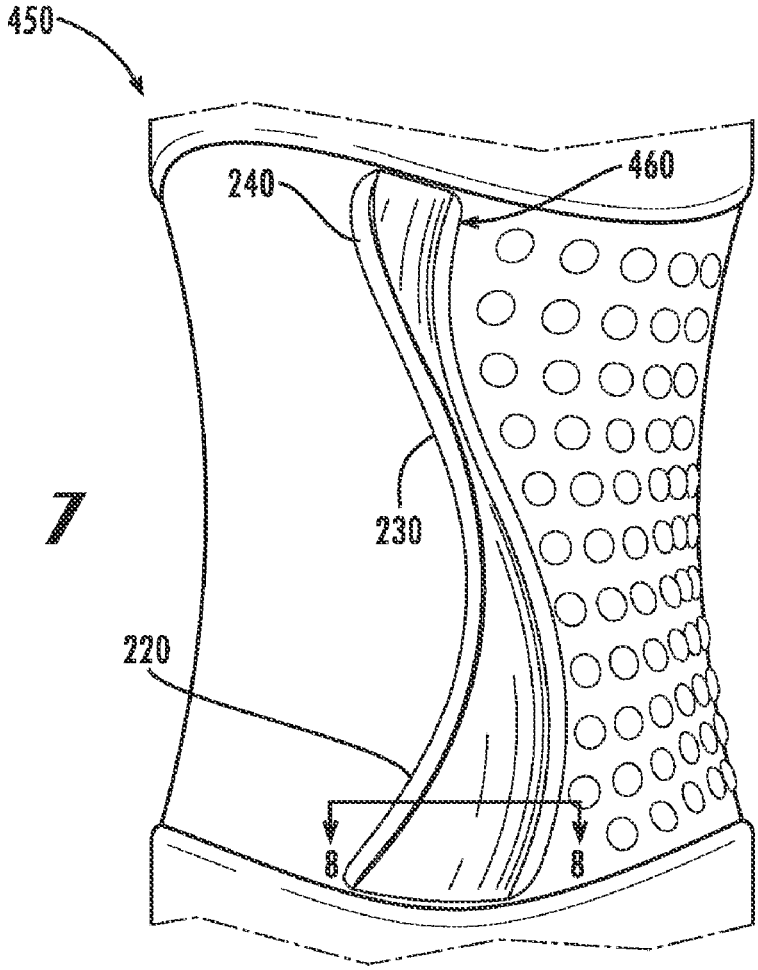
FIG. 7 is a side plan view of an alternative bottle.
Figure 8:
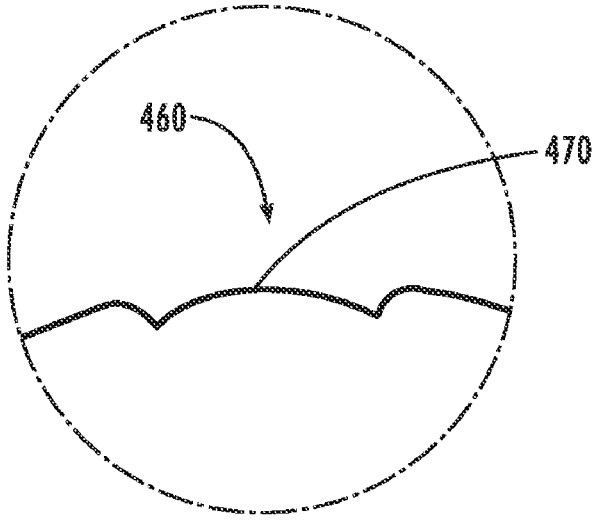
FIG. 8 is a side cross-sectional view of the bottle of FIG. 7.

FIGS. 7 and 8 show a further embodiment of a bottle 450 as is described herein. The bottle 450 includes a number of channels 460. The 460 channels include the first end 220, the middle portion 230, and second end 240. In this example, the surface of the channels 460 is bowed throughout such that it presents a relatively smooth surface. For example, the first end 220 may have a width of about 0.44 inches (about 11 millimeters). The first end 220 may have an original depth of about 0.4 inches (about 1 millimeter), returns to the original height, and then once again descends. The middle portion 230 and the second end 240 may be similarly shaped. The apex 470 of the bowed shape acts as a reinforcement similar to the use of the ribs described above.

Figure 9:
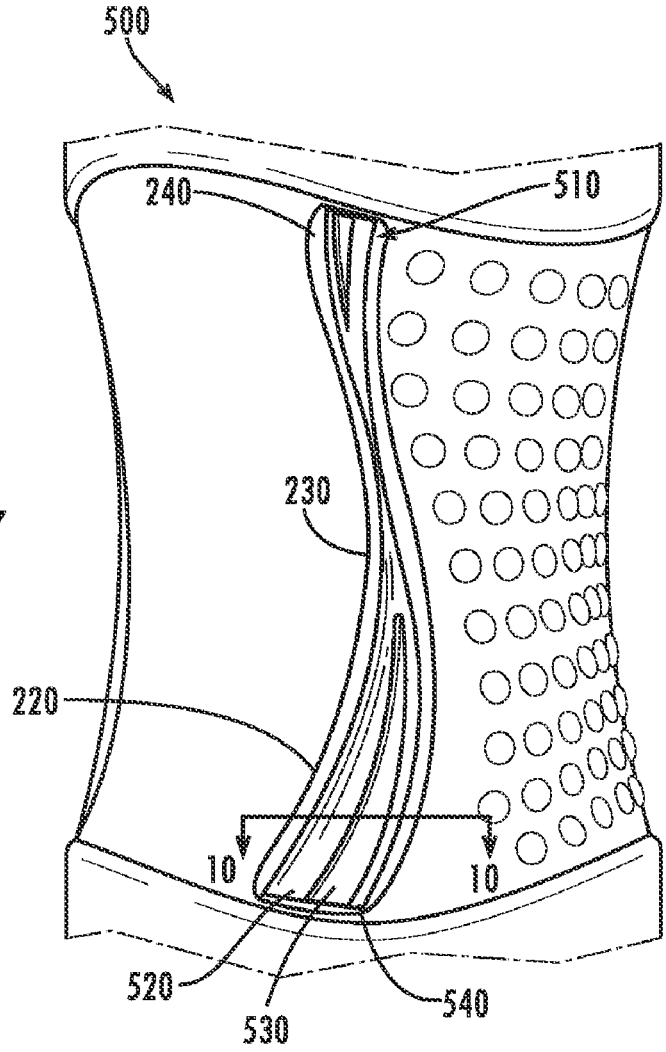
FIG. 9 is a side plan view of an alternative bottle.
Figure 10:
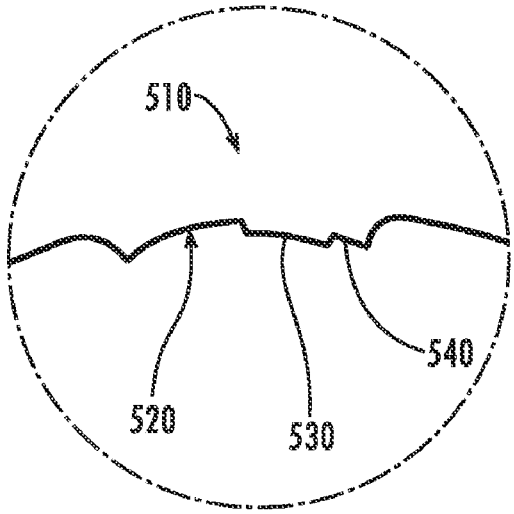
FIG. 10 is a side cross-sectional view of the bottle of FIG. 9.

FIGS. 9 and 10 show a further embodiment of a bottle 500 as is described herein. The bottle 500 includes a number of channels 510. Each of the channels 510 includes the first end 220, the middle portion 230, and the second end 240. In this example, the ends 220, 240 include a first column 520, a rib 530, and a second column 540. In this example, both the columns 520, 540 and the rib 530 are indented while also being bowed as described above. For example, the first end 220 may have an overall width of about 0.434 inches (about 11 millimeters). The first column 520 may have an original depth of about 0.04 inches (about 1 millimeter) and then return to its original height. The rib 530 then may have a further depth while the second column 540 may have a depth similar to the first column 520. The middle portion 230 and the second end 240 may have similar dimensions as those described above.

The dimensions used herein are by way of example only. Many modifications may be made herein as desired. For example, two or more of the channels described herein may be combined in a single bottle if desired.

It should be apparent that the foregoing relates only to the preferred embodiments of the present application and that numerous changes and modifications may be made herein by one of ordinary skill in the art without departing from the general spirit and scope of the invention as defined by the following claims and equivalents thereof.

We claim:

1. A pressure resistant thermoplastic container, comprising:

a sidewall;

a plurality of grip panels positioned on the sidewall;

a plurality of channels with one of the plurality channels positioned between and adjacent to a pair of the plurality of grip panels; and a plurality of indentations formed in the plurality of channels and extending into a circumference of the sidewall;

one or more of the plurality of indentations comprising one or more reinforcements formed therein.

2. The pressure resistant thermoplastic container of claim 1, further comprising a pressurized beverage therein.

3. The pressure resistant thermoplastic container of claim 2, wherein the pressurized beverage comprises up to about one hundred (100) pounds per square inch (about seven (7) bar).

4. The pressure resistant thermoplastic container of claim 1, further comprising PET (polyethylene terephthalate).

5. The pressure resistant thermoplastic container of claim 1, wherein the sidewall comprises a grip portion.

6. The pressure resistant thermoplastic container of claim 1, wherein the plurality of channels each comprise a first end, a middle portion, and a second end.

7. The pressure resistant thermoplastic container of claim 6, wherein the first end and the second end comprise one or more of the one or more reinforcements formed therein.

8. The pressure resistant thermoplastic container of claim 1, wherein the plurality of indentations comprises a first column on a first side of one of the one or more reinforcements and a second column on a second side of the one of the one or more reinforcements.

9. The pressure resistant thermoplastic container of claim 8, wherein the first column and the second column comprise indented portions and wherein the one of the one or more reinforcements comprises a raised rib.

10. The pressure resistant thermoplastic container of claim 9, wherein the plurality of indentations comprises a third column and wherein the one or more reinforcements comprise a second raised rib.

11. The pressure resistant thermoplastic container of claim 8, wherein the first column and the second column comprise indented portions and wherein the one of the one or more reinforcements comprises an indented rib.

12. The pressure resistant thermoplastic container of claim 11, wherein the plurality of indentations comprises a third column and wherein the one or more reinforcements comprise a second indented rib.

13. The pressure resistant thermoplastic container of claim 1, wherein the plurality of indentations comprises a bowed surface and the one or more reinforcements comprise an apex of the bowed surface.

14. The pressure resistant thermoplastic container of claim 1, wherein the plurality of indentations comprises a bowed surface and the one or more reinforcements comprise a rib in the bowed surface.

15. The pressure resistant thermoplastic container of claim 14, wherein the rib in the bowed surface comprises an indented rib.

16. A pressure resistant thermoplastic container, comprising:

a sidewall; and a plurality of indentations formed in the sidewall;

one or more of the plurality of indentations comprising one or more reinforcements formed therein;

wherein the plurality of indentations comprises a plurality of channels;

wherein the plurality of channels comprises a first end, a middle portion, and a second end; and wherein the middle portion lacks the one or more reinforcements.

17. A pressure resistant thermoplastic bottle, comprising:

a sidewall;

a plurality of grip panels positioned on the sidewall;

a plurality of channels with one of the plurality channels positioned between and adjacent to a pair of the plurality of grip panels; and a plurality of indentations formed in the plurality of channels and extending into a circumference of the sidewall;

the plurality of indentations comprising means for reinforcement formed therein.

18. The pressure resistant thermoplastic bottle of claim 17, further comprising a beverage therein pressurized up to about one hundred (100) pounds per square inch (about seven (7) bar).

19. The pressure resistant thermoplastic container of claim 17, wherein the means for reinforcement comprise a plurality of raised ribs.

20. The pressure resistant thermoplastic container of claim 17, wherein the means for reinforcement comprise an indented rib.

21. The pressure resistant thermoplastic container of claim 17, wherein the means for reinforcement comprise a plurality of indented ribs.

22. The pressure resistant thermoplastic container of claim 17, wherein the means for reinforcement comprise an apex of a bowed surface.

* * * * *